US007708059B2

(12) United States Patent
Shaw

(10) Patent No.: US 7,708,059 B2
(45) Date of Patent: May 4, 2010

(54) SUBSEA WELL HAVING A SUBMERSIBLE PUMP ASSEMBLY WITH A GAS SEPARATOR LOCATED AT THE PUMP DISCHARGE

(75) Inventor: Chris K. Shaw, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/939,038

(22) Filed: Nov. 13, 2007

(65) Prior Publication Data

US 2009/0120638 A1 May 14, 2009

(51) Int. Cl.
*E21B 43/00* (2006.01)

(52) U.S. Cl. ..... 166/105.5; 417/77; 417/80; 417/84

(58) Field of Classification Search ..... 166/369, 166/68, 105.5; 417/77, 79, 80, 84, 313, 423.3
See application file for complete search history.

(56) References Cited

U.S. PATENT DOCUMENTS 4,083,660 A * 4/1978 Newbrough ..... 417/108
4,805,697 A * 2/1989 Fouillout et al. ..... 166/265
4,981,175 A 1/1991 Powers
5,133,639 A 7/1992 Gay et al.
5,407,323 A 4/1995 Gay et al.
5,624,249 A 4/1997 Rohlfing
5,823,262 A * 10/1998 Dutton ..... 166/250.15
6,007,306 A 12/1999 Vilagines
6,089,317 A * 7/2000 Shaw ..... 166/265
6,352,109 B1 * 3/2002 Buckman, Sr. ..... 166/250.03
6,668,925 B2 * 12/2003 Shaw et al. ..... 166/265
6,684,946 B2 2/2004 Gay et al.
6,854,517 B2 2/2005 Gay et al.
6,899,517 B2 5/2005 Gay et al.
7,059,345 B2 6/2006 Shaw
7,094,016 B1 8/2006 Zaher
7,150,325 B2 12/2006 Ireland et al.
7,409,997 B2 8/2008 Gay et al.

OTHER PUBLICATIONS

Grimstad, Haakon J., Subsea Multiphase Boosting-Maturing Technology Applied for Santos Ltd's Mutineer and Exeter Field, SPE International, SPE 88562, 2004.

* cited by examiner

*Primary Examiner*—Jennifer H Gay
*Assistant Examiner*—Elizabeth C Gottlieb
(74) *Attorney, Agent, or Firm*—Bracewell & Guiliani LLP

(57) ABSTRACT

A subsea rotary gas separator system has a separator located adjacent the discharge of the pump for separating gas from the high pressure liquid stream exiting the pump. Some of the high pressure liquid is recycled back to the inlet of the pump to maintain a liquid-rich inlet stream for the pump.

20 Claims, 2 Drawing Sheets

SUBSEA WELL HAVING A SUBMERSIBLE PUMP ASSEMBLY WITH A GAS SEPARATOR LOCATED AT THE PUMP DISCHARGE

BACKGROUND OF THE INVENTION

1. Technical Field

The present invention relates in general to downhole gas separators and, in particular, to an improved system, method, and apparatus for a submersible pump assembly having a gas separator that produces a liquid stream for reintroduction upstream of the pump.

2. Description of the Related Art

Subsea wells typically connect to a subsea manifold that delivers the well fluid to a production platform for processing, particularly for the removal of water and gas. The oil is then transmitted to a pipeline or other facility for export from the production platform. Production of fluids from a medium to deep subsea environment requires compensation for the effects of cold temperatures, high ambient pressures and fluid viscosity as a function of break out of gas in the fluid stream. In flowing wells, particularly those with light API fluid, these conditions may be mitigated by the nature of the producing reservoir. In wells with low API oil and insufficient pressure to drive the fluid to the surface, some form of artificial lift will be required.

One type of artificial lift for wells employs a submersible pump, which is a type that has been used for many years on land-based wells. One type of submersible pump assembly has an electrical motor, a rotary pump and a seal section located between the pump and the motor for equalizing wellbore pressure with the internal pressure of lubricant in the motor. In applications where there is a high free gas content in the fluid production stream, the gas content is typically separated upstream from the rotary pump intake.

In other types of applications, the recycling of discharge liquids back to the suction to reduce the free gas content percentage also is known. However, in a traditional gas separation application, the gas stream has entrained liquids that are together recycled back to the inlet of the pump below the gas outlet. Although this design is workable for some application, an improved solution for increasing the hydraulic efficiency of the system and improving flow conditioning through the pump would be desirable.

SUMMARY OF THE INVENTION

Embodiments of a system, method, and apparatus for a subsea well having a submersible pump assembly with a gas separator are disclosed. The gas separator is located adjacent the discharge of the submersible pump and separates gas from the high pressure liquid stream exiting the pump.

The invention is particularly well suited for gaseous environments as a portion of the discharge is a high pressure liquid that is recycled back to the inlet of the pump to maintain a liquid-rich inlet stream for the pump. The recycled portion of the discharge, which is essentially 100% liquid, may be returned internally or externally relative to the pump housing. The remainder of the pump discharge is mixed flow. The separator may utilize a centrifuge or static device (e.g., enhanced gravity). In addition, the stream may be reintroduced via a jet pump venturi eductor whereby the stream acts as the power fluid.

This design has the advantages of flow conditioning and some pressure recovery to improve the hydraulic efficiency of the system. Dispersal of gas homogeneously through the intake liquid is a significant aspect of pumping gassy fluids.

The same venturi also may be linked at the vena contracta to a gas accumulation location in order to draw in and mix any gas accumulations. In one embodiment, the recycled liquid stream has entrained gas bubbles that are less than approximately 10 μm in size. A limited amount of gas acceptably enters the pump since a separator can only achieve one relatively clean stream.

In other embodiments, the recycled liquid stream may have a feedback flow control that monitors fluid density and/or mass flow rate. In addition, the recycle feature of the invention may be suspended when the inlet flow for the pump exceeds a minimum threshold density. The venturi itself may be used as a flow conditioner to measure density by pressure drop or Coriolis effect.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
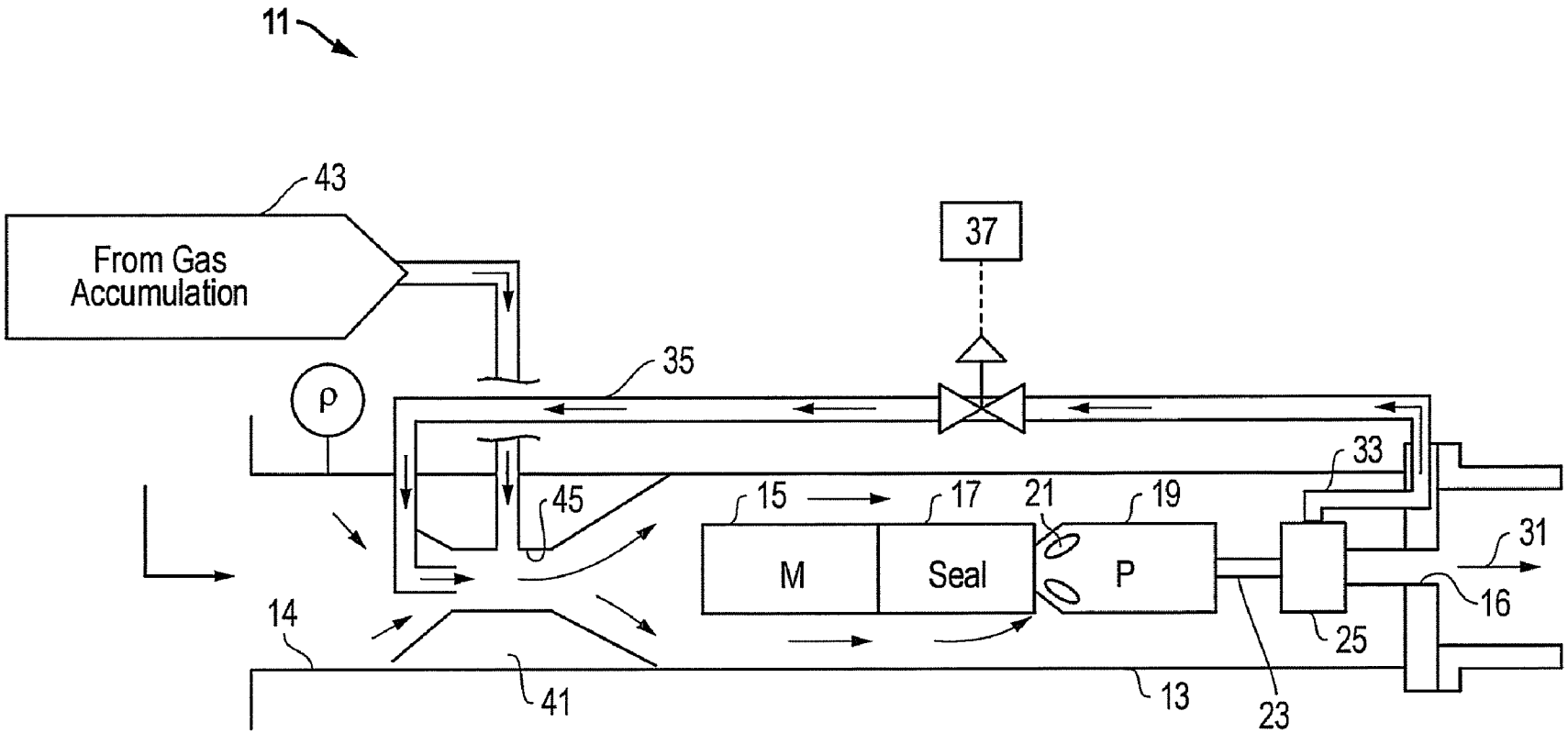
FIG. 1 is a sectional side view of one embodiment of a downhole assembly constructed in accordance with the invention.

Referring to FIG. 1, embodiment of a system, method and apparatus for a subsea well having a submersible pump assembly with a gas separator are shown and described. The submersible pump assembly 11 may be located within a capsule 13 having an inlet 14 for receiving intake fluids having mixed liquids and gas, and an outlet 16 for discharging outlet fluid. Alternatively, the components of the submersible pump assembly 11 may be secured to each other inside a permanent well casing 13.

The pump assembly 11 may be supported by a support (not shown) located on the lower (i.e., left) side of housing 13. A variety of other devices could be employed to mount the pump assembly 11 within housing 13. The pump assembly 11 may be secured to the support to transmit thrust to the housing 13. Pump assembly 11 is of a type that is conventionally installed downhole within a subsea well for pumping well fluids to the surface.

The pump assembly 11 includes a submersible electrical motor 15, such as a three-phase AC motor. Motor 15 is supplied with power through a power cable (not shown) that extends sealingly through the top or sidewall of the housing 13. The motor 15 is coupled to a seal section 17 that protects the motor from ingress of production fluid, which could contaminate the clean lubricant contained within motor 15. Seal section 17 also reduces any pressure differential between the exterior of motor 15 and the pressure of the lubricant within motor 15. Seal section 17 is connected to a pump 19, which may comprise a centrifugal pump or a static device with enhanced gravity. Motor 15, seal 17, and pump 19 may be mounted coaxially within housing 13.

In one embodiment, the pump 19 is made up of a plurality of stages of impellers and diffusers located within a cylindrical pump housing. Pump 19 has an intake 21 located at its upstream end. Pump 19 also has a discharge tube 23 that is in fluid communication with a gas separator 25. The gas separator 25 is located downstream from the pump 19 and adjacent to the outlet 16 for receiving the outlet fluid from the pump 19.

The gas separator 25 discharges (1) a mixed flow stream 31 of gas and liquid to the outlet 16, and (2) a recycled liquid stream 33. In one embodiment, the mixed flow stream 31 is a substantially dry gas stream. The recycled liquid stream 33 may have gas bubbles on the order of approximately 10 μm. Thus, the recycled liquid stream 33 is essentially 100% liquid. In one embodiment, only a fraction of the total stream is recycled (e.g., 30%) and making this stream substantially liquid is possible provided that the inlet liquid percentage exceeds, for example, 40% liquid. An inlet fluid having at least 40% liquid is derived as the minimum amount of liquid when about 20% of the total input stream is recycled (with 100% liquid in recycle), as the maximum amount of gas that can be tolerated is about 30%.

A conduit 35 extends from the gas separator 25 for recycling the liquid stream 33 to the inlet 14 for maintaining a liquid-rich inlet stream for the pump 19. The conduit may be located external to the pump housing 13 as shown, or extend internally through the capsule/well casing (not shown). The conduit 35 may be provided with feedback flow control 37 for monitoring fluid density and/or mass flow rate of the liquid stream 33.

In one embodiment, the inlet 14 comprises a jet pump type venturi eductor 41 and the liquid stream 33 is reintroduced via the jet pump venturi eductor 41 as shown. If structure 13 is a capsule, the jet pump components may be integrally formed as part of the capsule. Alternatively, if structure 13 is a permanent well casing, the eductor 41 may be mounted to an insert, such as a packer.

The jet pump venturi eductor 41 may comprise a flow conditioner for measuring a density of the intake fluid by pressure drop, mass flow rate or Coriolis effect. In the latter case, high pressure is recovered by reflowing the recycled liquid through the venturi. Recycling of the liquid stream 33 may be suspended when the intake flow for the pump exceeds a minimum threshold density. In another embodiment, the system includes a gas accumulator 43 for accumulating gas, wherein the jet pump venturi eductor 41 has a vena contracta 45 for introducing gas from the gas accumulator 43.

Figure 2:
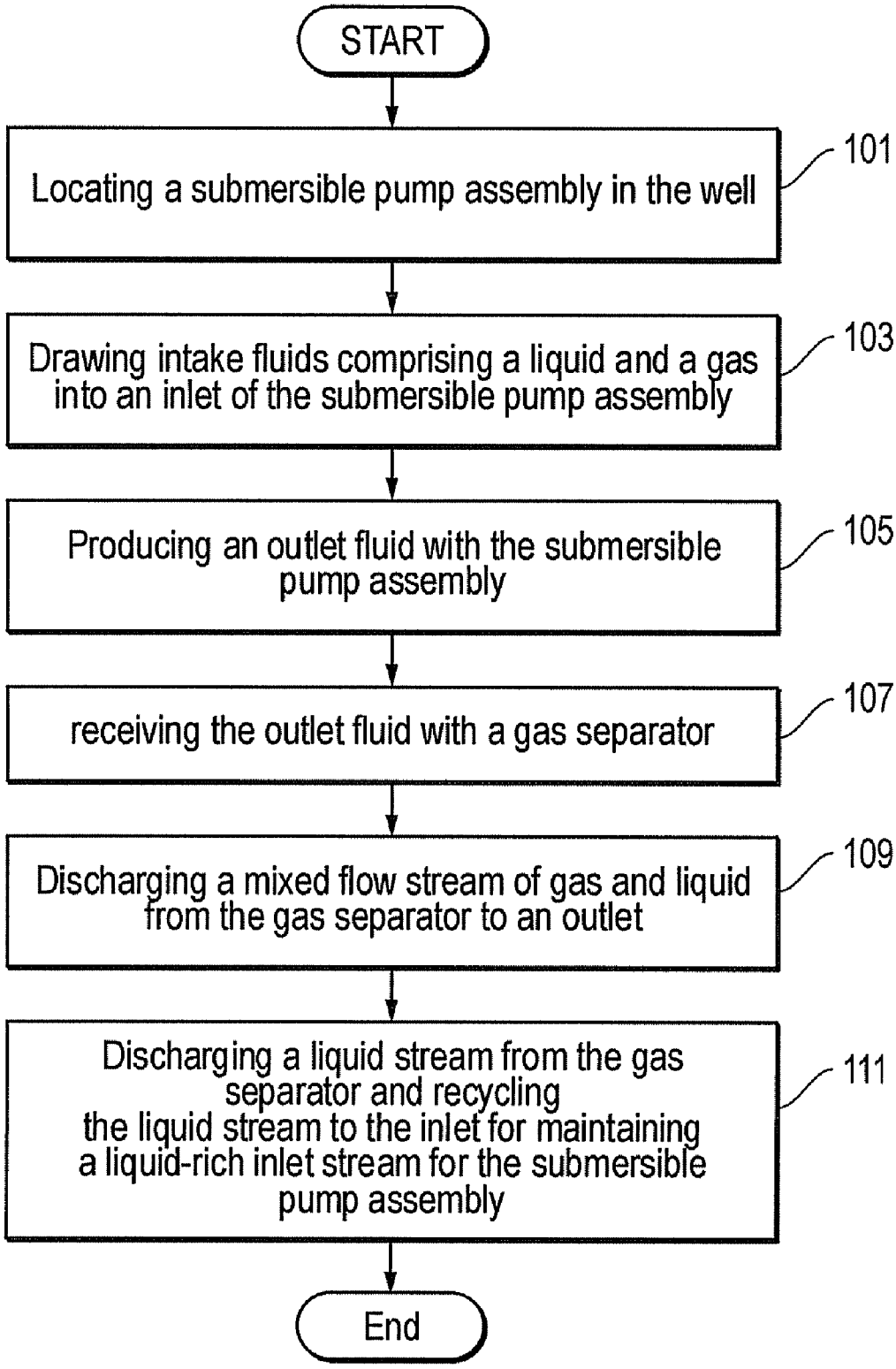
FIG. 2 is a high level flow diagram of one embodiment of a method constructed in accordance with the invention.

Referring now to FIG. 2, one embodiment of a method of producing production fluids from a well in accordance with the invention is shown. The method starts as indicated and comprises locating a submersible pump assembly in the well (step 101); drawing intake fluids comprising a liquid and a gas into an inlet of the submersible pump assembly (step 103); producing an outlet fluid with the submersible pump assembly (step 105); receiving the outlet fluid with a gas separator (step 107); discharging a mixed flow stream of gas and liquid from the gas separator to an outlet (step 109); discharging a liquid stream from the gas separator and recycling the liquid stream to the inlet for maintaining a liquid-rich inlet stream for the submersible pump assembly (step 111); before ending as indicated.

In other embodiments, the method comprises discharging an essentially 100% liquid stream. The liquid stream quality is such that the entrained gas bubbles are less than approximately 10 μm in size. The method also may comprise receiving the intake fluids and liquid stream with a jet pump venturi eductor at the inlet, respectively. The method may further comprise accumulating gas with a gas accumulator, and introducing gas from the gas accumulator to the jet pump venturi eductor through a vena contracts. In still other embodiments, the method may comprise monitoring at least one of fluid density and mass flow rate a feedback flow control; and/or suspending recycling of the liquid stream when the intake fluids exceeds a minimum threshold density.

While the invention has been shown or described in only some of its forms, it should be apparent to those skilled in the art that it is not so limited, but is susceptible to various changes without departing from the scope of the invention.

What is claimed is:

1. A submersible pump assembly, comprising:

an inlet for receiving intake fluid comprising liquids and gas, and an outlet;

a motor, a lift pump, and a seal between the motor and pump, all mounted between the inlet and the outlet such that the pump draws the intake fluid through the inlet and discharges outlet fluid;

a gas separator located downstream from the lift pump for receiving fluid from the lift pump, the gas separator discharging a mixed flow stream of gas and liquid to the outlet, and a liquid stream that is separate from the mixed flow stream; and a conduit for recycling the liquid stream to the inlet for maintaining a liquid-rich inlet stream for the lift pump.

2. The pump assembly according to claim 1, wherein the gas separator receives fluid from the lift pump through a discharge tube, is located adjacent to the outlet and connected to the outlet with a tube, and the liquid stream is approximately 100% liquid.

3. The pump assembly according to claim 1, wherein the gas separator utilizes one of a centrifuge and a static device with enhanced gravity.

4. The pump assembly according to claim 1, wherein the inlet comprises a jet pump venturi eductor and the liquid stream is reintroduced via the jet pump venturi eductor.

5. The pump assembly according to claim 4, further comprising a gas accumulator adjacent the inlet for accumulating gas, and wherein the jet pump venturi eductor has a vena contracta for introducing gas from the gas accumulator.

6. The pump assembly according to claim 4, wherein the jet pump venturi eductor further comprises a flow conditioner for measuring a density of the intake fluid by pressure drop, mass flow rate or Coriolis effect whereby high pressure is recovered by reflowing recycled liquid through a vena contracta.

7. The pump assembly according to claim 1, wherein the mixed flow stream of gas and liquid is substantially dry having an entrained liquid drop size of less than approximately 10 μm.

8. The pump assembly according to claim 1, wherein the conduit has a feedback flow control that monitors at least one of fluid density and mass flow rate.

9. The pump assembly according to claim 1, wherein recycling of the liquid stream is suspended when the intake fluids for the lift pump exceed a minimum threshold density, whereby a venturi comprising a flow conditioner is used to measure density by pressure drop or Coriolis effect.

10. The pump assembly according to claim 1, wherein the motor, lift pump, seal and gas separator are located in one of a capsule and a permanent well casing.

11. The pump assembly according to claim 1, wherein a discharge of the lift pump comprises well fluids being pumped to the surface.

12. A system for a submersible pump assembly, comprising:

a capsule having an inlet for receiving intake fluid comprising liquids and gas, and an outlet located opposite the inlet;

a motor, a lift pump, and a seal between the motor and the lift pump, all mounted coaxially in the capsule between the inlet and the outlet such that the lift pump draws the intake fluid through the inlet and discharges outlet fluid;

a gas separator located downstream from the lift pump for receiving fluid from the lift pump, the gas separator discharging a mixed flow stream of gas and liquid to the outlet having an entrained liquid drop size of less than approximately 10 μm, and a liquid stream that is separate from the mixed flow stream; and a conduit for recycling the liquid stream to the inlet for maintaining a liquid-rich inlet stream for the lift pump.

13. The system according to claim 12, wherein the gas separator is located adjacent to the outlet, and the liquid stream is approximately 100% liquid.

14. The system according to claim 12, wherein the conduit extends through one of an interior and an exterior of the capsule.

15. The system according to claim 12, wherein the gas separator utilizes one of a centrifuge and a static device with enhanced gravity.

16. The system according to claim 12, wherein the inlet comprises a jet pump venturi eductor and the liquid stream is reintroduced via the jet pump venturi eductor.

17. The system according to claim 16, further comprising a gas accumulator adjacent the capsule for accumulating gas, and wherein the jet pump venturi eductor has a vena contracta for introducing gas from the gas accumulator.

18. The system according to claim 16, wherein the jet pump venturi eductor further comprises a flow conditioner for measuring a density of the intake fluid by pressure drop, mass flow rate or Coriolis effect whereby high pressure is recovered by reflowing recycled liquid through the vena contracta.

19. The system according to claim 12, wherein the conduit has a feedback flow control that monitors at least one of fluid density and mass flow rate.

20. The system according to claim 12, wherein the capsule is a permanent well casing, and recycling of the liquid stream is suspended when the intake flow for the lift pump exceeds a minimum threshold density, whereby a venturi comprising a flow conditioner is used to measure density by pressure drop or Coriolis effect.

* * * * *